US007137677B2

(12) United States Patent
Hong et al.

(10) Patent No.: US 7,137,677 B2
(45) Date of Patent: Nov. 21, 2006

(54) REFRIGERATOR

(75) Inventors: Dae Jin Hong, JeollaNam-Do (KR); Gi Joong Jeong, Gwangiu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 313 days.

(21) Appl. No.: 10/814,792

(22) Filed: Apr. 1, 2004

(65) Prior Publication Data

US 2005/0218764 A1 Oct. 6, 2005

(30) Foreign Application Priority Data

Mar. 30, 2004 (KR) ..... 10-2004-0021499

(51) Int. Cl.
*F25D 17/06* (2006.01)

(52) U.S. Cl. ..... 312/401; 312/265.6

(58) Field of Classification Search ..... 312/265.5, 312/265.6, 204, 351.1, 257.1, 236, 401, 405, 312/406, 278; 62/440, 441, 455, 454, 265
See application file for complete search history.

(56) References Cited

U.S. PATENT DOCUMENTS 2,660,505 A * 11/1953 Eck ..... 312/236
2,673,455 A * 3/1954 Brinkoeter ..... 62/248
2,889,901 A * 6/1959 Morrissey, Jr. et al. ..... 52/750

FOREIGN PATENT DOCUMENTS

JP 11196955 * 7/1999

(Continued)

OTHER PUBLICATIONS

Korean Patent Abstract for Korean Publication No. 2002-59527, published Jul. 13, 2002.

(Continued)

*Primary Examiner*—Janet M. Wilkens
(74) *Attorney, Agent, or Firm*—Staas & Halsey LLP

(57) ABSTRACT

A refrigerator including an improved lower cover. The refrigerator comprises a main body having a storage compartment defined therein, and a lower cover mounted to the lower end of the front part of the main body such that the front part of the lower cover and the front part of the main body together form the same plane, wherein the lower cover is provided with an engaging member bent from the upper end of the lower cover toward the rear of the main body while being extended a prescribed length, the engaging member being successively formed in the lateral direction thereof, and wherein the main body is provided at the bottom part thereof with an engaging groove corresponding to the engaging member of the lower cover, the engaging member of the lower cover being engaged with the engaging groove of the main body. The lower cover is not protruded from the front part of the main body, and fixed parts of the lower cover are not exposed to the outside, whereby an aesthetic appearance of the refrigerator is provided, and formation of a gap between the lower cover and the lower end of main body is prevented.

10 Claims, 4 Drawing Sheets

U.S. PATENT DOCUMENTS 3,403,529 A * 10/1968 Reber, Jr. ..... 62/277
4,543,800 A * 10/1985 Mawby et al. ..... 62/339
4,932,224 A * 6/1990 Katterhenry et al. ..... 62/440
4,973,109 A * 11/1990 Diedrich ..... 312/114
5,119,271 A * 6/1992 Aoki et al. ..... 361/682
5,265,954 A * 11/1993 Keil ..... 312/405
6,030,064 A * 2/2000 Kim ..... 312/405
6,036,292 A * 3/2000 Mandel et al. ..... 312/405
6,036,293 A * 3/2000 Anell et al. ..... 312/406
6,532,757 B1 * 3/2003 Holzer et al. ..... 62/331

FOREIGN PATENT DOCUMENTS

JP 2000157380 * 6/2000

OTHER PUBLICATIONS

Korean Patent Abstract for Korean Publication No. 2001-60682, published Jul. 7, 2001.

* cited by examiner

REFRIGERATOR

CROSS-REFERENCE TO RELATED APPLICATION

This application claims the benefit of Korean Patent Application No. 2004-21499, filed Mar. 30, 2004 in the Korean Intellectual Property Office, the disclosure of which is incorporated herein by reference.

BACKGROUND OF THE INVENTION

1. Field of the Invention

The present invention relates to a refrigerator, and more particularly to improvement to a lower cover for covering the space between the bottom part of a main body of the refrigerator and a floor.

2. Description of the Related Art

Generally, a refrigerator includes a main body disposed on a floor by means of a plurality of supporting legs while the bottom part of the main body is spaced apart from the floor. To the lower end of the front part of the main body is mounted a lower cover for covering the space between the main body and the floor, by which the aesthetic appearance of the refrigerator is provided, and preventing noise, which is generated from the rear of the main body, from being transmitted to the front of the main body through the space between the main body and the floor.

The front part of the lower cover is generally protruded from the front part of the main body so that the front parts of the lower cover and the main body together form the same plane when the door of the refrigerator is closed. The lower cover is fixed to the lower end of the main body by means of a plurality of fixing screws or by means of engaging units provided between the main body and the inner part of the lower cover.

However, the above-mentioned conventional refrigerator does not provide an aesthetic appearance since the lower cover is protruded forward from the lower end of the front part of the main body. The lower cover may be broken or separated from the main body when a child steps on the lower cover while the door of the refrigerator is opened.

Furthermore, the other parts of the lower cover except the fixing screws or the engaging units may be deformed since the lower cover of the conventional refrigerator is fixed to the main body by means of the plurality of fixing screws, which are provided at several positions, or by means of the engaging units, which are locally provided, with the result that a gap is formed between the main body and the lower cover. Also, the conventional refrigerator does not provide an aesthetic appearance since screw-engaging parts fixed by means of the fixing screws are exposed to the outside.

SUMMARY OF THE INVENTION

Therefore, an object of the invention is to provide a refrigerator including a lower cover not protruded from the front part of a main body of the refrigerator, wherein fixed parts of the lower cover are not exposed to the outside, thereby providing an aesthetic appearance.

Another object of the invention is to provide a refrigerator that is capable of preventing formation of a gap between the lower cover and the lower end of main body.

In accordance with one aspect, the present invention provides a refrigerator comprising: a main body having a storing chamber defined therein; and a lower cover mounted to the lower end of the front part of the main body such that the front part of the lower cover and the front part of the main body together form the same plane.

Preferably, the lower cover is provided with an engaging member bent from the upper end of the lower cover toward the rear of the main body while being extended a prescribed length, and the main body is provided at the bottom part thereof with an engaging groove corresponding to the engaging member of the lower cover, the engaging member of the lower cover being engaged with the engaging groove of the main body.

Preferably, the engaging groove has an inner height larger than the vertical thickness of the engaging member, and the engaging member is provided with a bent portion elastically deformed so that the engaging member is forcibly engaged with the engaging groove.

Preferably, the bent portion comprises: a first bent portion bent from the position spaced a prescribed distance from the front part of the lower cover toward the rear of the bent portion while being inclined downward; and a second bent portion bent from the first bent portion toward the rear of the main body.

Preferably, the engaging member and the engaging groove are successively formed in the lateral direction of the lower cover.

Preferably, the refrigerator further comprises: at least one door attached to the front part of the main body; and at least one hinge provided at at least one of both lower sides of the front part of the main body for supporting the door, the lower cover being provided with at least one opened portion for allowing the hinge to be extended forward therethrough.

Preferably, the refrigerator further comprises: first screw-engaging parts extended a prescribed length from the opened portions toward the rear of the main body for fixing the lower cover; second screw-engaging parts provided at the bottom part of the main body, the second screw-engaging parts corresponding to the first screw-engaging parts; and fixing screws for fixing the first screw-engaging parts to the second screw-engaging parts.

Preferably, the lower cover includes a front part having a length corresponding to the width of the front part of the main body and a height corresponding to the height of the space between the lower end of the front part of the main body and the floor.

BRIEF DESCRIPTION OF THE DRAWINGS

The above objects, and other features and advantages of the present invention will become more apparent after reading the following detailed description when taken in conjunction with the drawings, in which.

DETAILED DESCRIPTION OF THE PREFERRED EMBODIMENTS

A preferred embodiment of the present invention will now be described in detail with reference to the accompanying drawings.

Figure 1:
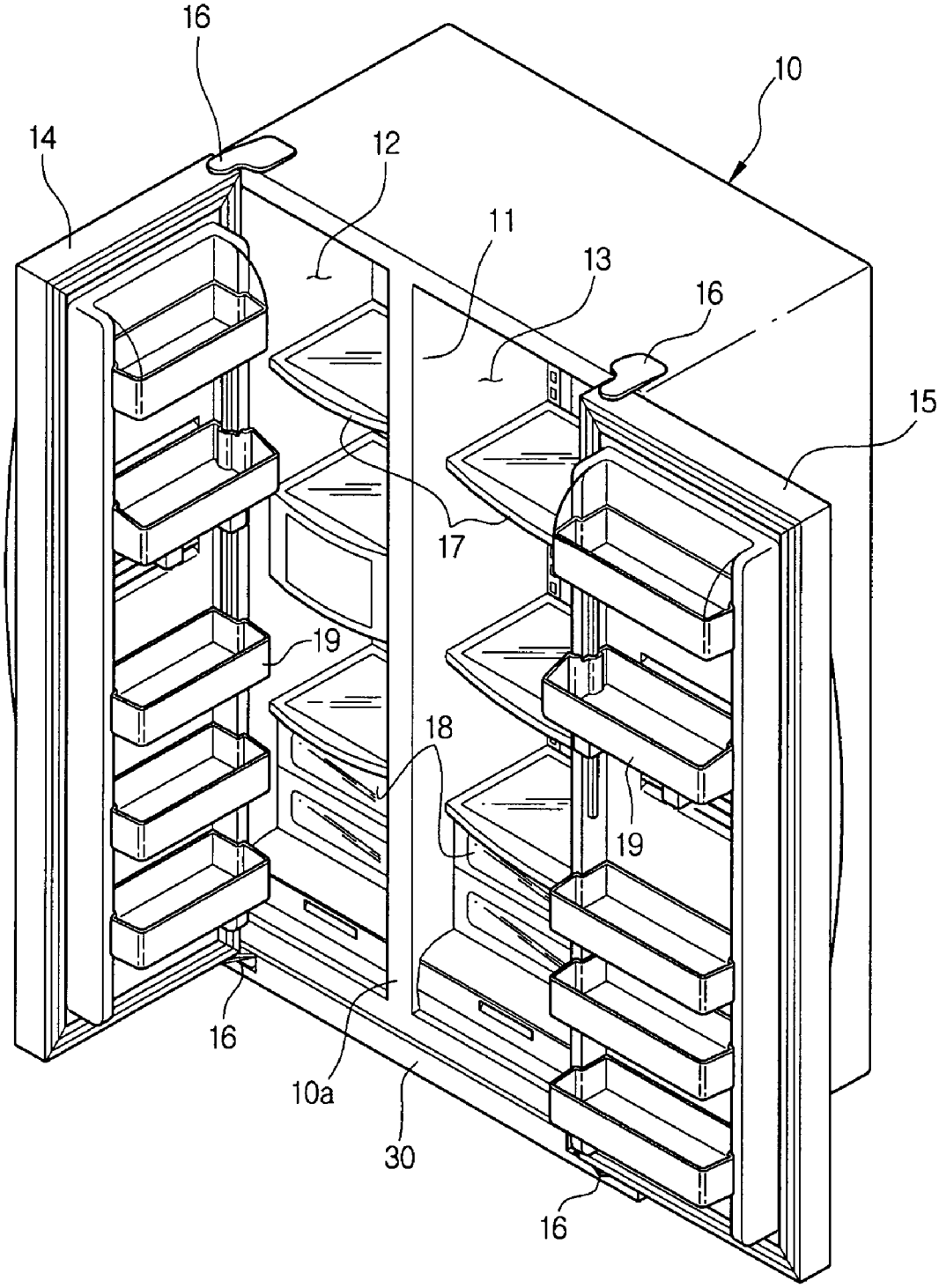
FIG. 1 is a perspective view illustrating the outer appearance of the front part of a refrigerator according to the present invention.

As shown in FIG. 1, a refrigerator according to the present invention comprises: a main body 10 having an inner storing space defined therein, the inner storing space being partitioned into a freezer compartment 12 and a refrigerator compartment 13 by means of a partition wall 11; and a freezer compartment door 14 and a refrigerator compartment door 15 attached to a front part 10*a* of the main body 10 for closing the freezer compartment 12 and the refrigerator compartment 13. The freezer compartment door, 14 and the refrigerator compartment door 15 are pivotably supported by means of hinges 16 provided at the upper and lower ends of both sides of the front part of the main body 10, respectively. In the freezer compartment 12 and the refrigerator compartment 13 are disposed a plurality of shelves 17 and storing boxes 18. To the insides the freezer and refrigerator compartment doors 14 and 15 are attached a plurality of door pockets 19, respectively.

Figure 2:
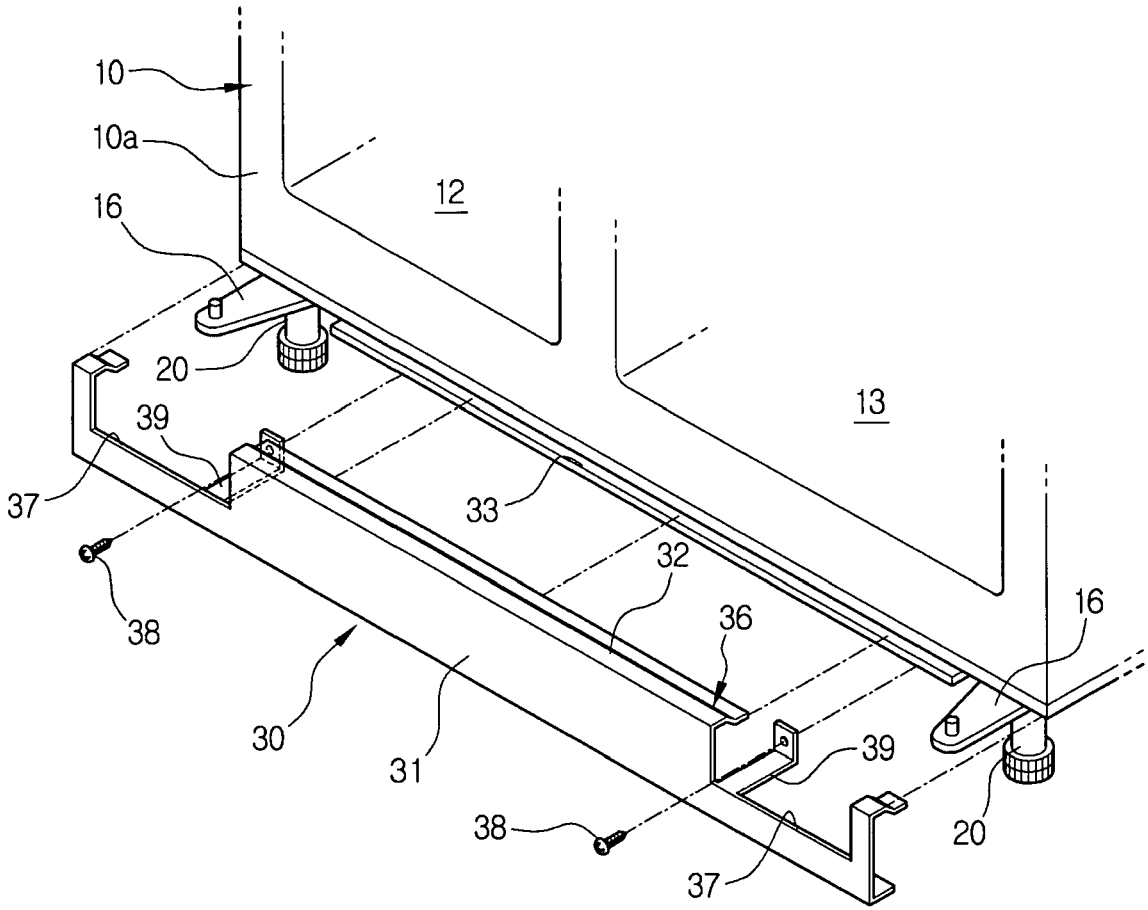
FIG. 2 is an exploded perspective view illustrating the construction of a lower cover of the refrigerator according to the present invention and how to mount the lower cover to the refrigerator.
Figure 3:
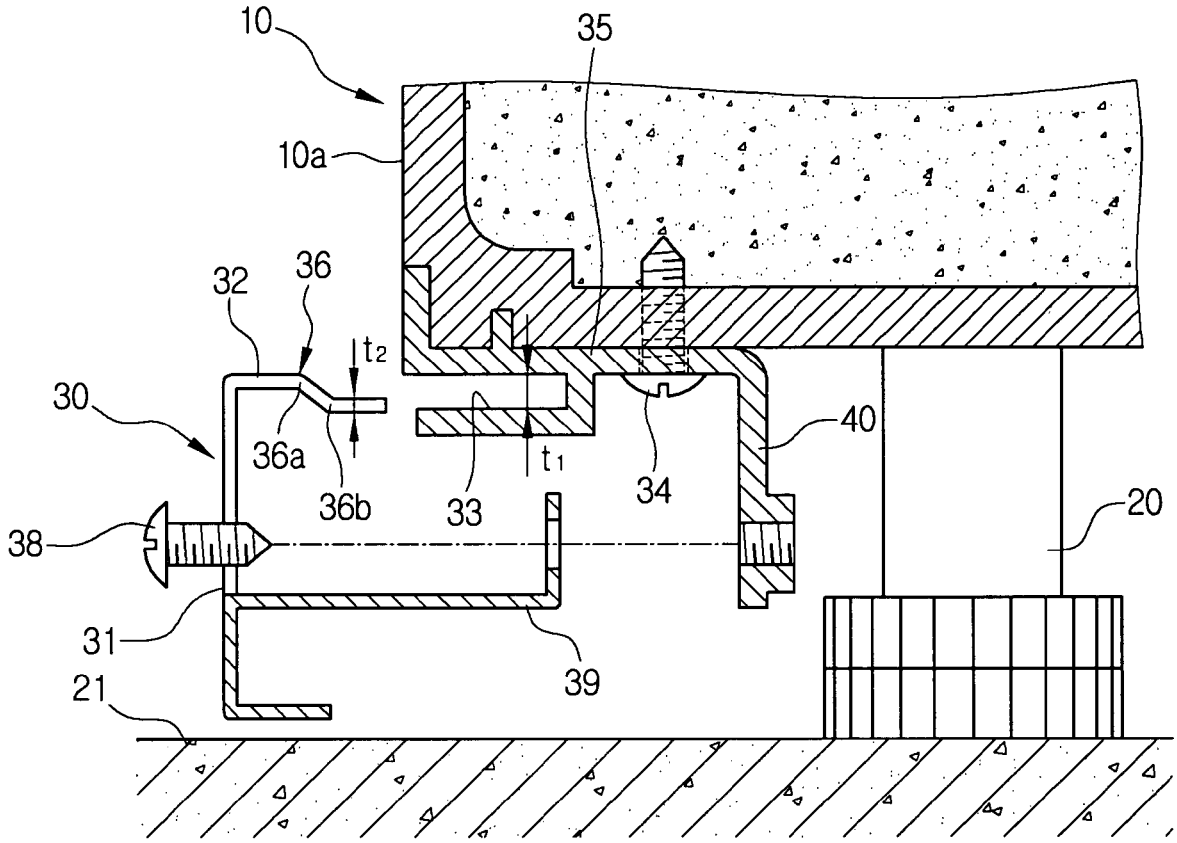
FIG. 3 is a sectional view illustrating how to mount the lower cover to the refrigerator according to the present invention, the lower cover being separated from the refrigerator.

As shown in FIGS. 2 and 3, the main body has a bottom part mounted on a floor 21 by means of a plurality of supporting legs 20 while being spaced apart from the floor 21. To the lower end of the front part 10*a* of the main body 10 is mounted a lower cover 30 for covering the space between the main body 10 and the floor 21, providing the aesthetic appearance of the refrigerator, and preventing noise, which is generated from the rear of the main body, from being transmitted to the front of the main body 10 through the space between the main body 10 and the floor 21.

The lower cover 30 of the refrigerator is a pipe-shaped panel having a front part 31, the length of which corresponds to the width of the front part of the main body 10, and the height of which corresponds to the height of the space between the lower end of the front part of the main body 10 and the floor 21. The lower cover 30 is made by means of injection molding of a resin material or by means of cutting and bending a metal sheet.

The lower cover 30 is provided with an engaging member 32, which is bent from the upper end of the lower cover 30 toward the rear of the main body 10 while being extended a prescribed length for engaging with the lower end of the main body 10. The main body 10 is provided at the bottom part thereof with an engaging groove 33 having an open front part for engaging with the engaging member 32. The engaging member 32 and the engaging groove 33 are longitudinally formed in the lateral direction of the lower cover 30 so that the lower end of the main body 10 is successively engaged with the upper end of the lower cover 30. As shown in FIG. 3, the engaging groove 33 is formed at a supporting member 35, which is fixed to the bottom part of the main body 10 by means of a fixing screw 34, although the engaging groove 33 may be formed of a molded metal integrally formed with the bottom part of the main body 10.

Figure 4:
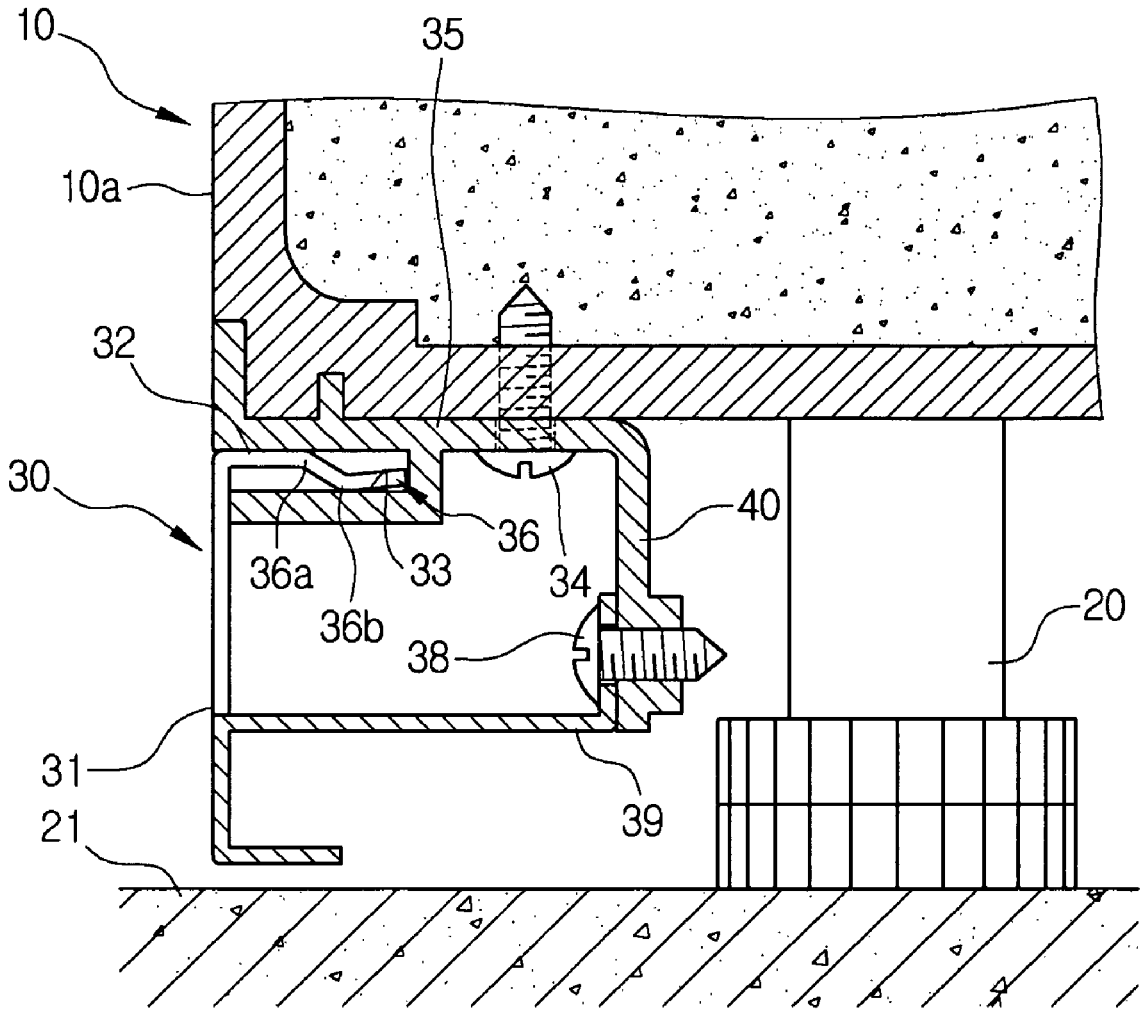
FIG. 4 is a sectional view illustrating how to mount the lower cover to the refrigerator according to the present invention, the lower cover being mounted to the refrigerator.

A detailed description will now be given of how to mount the lower cover 30 to the main body 10 of the refrigerator with reference to FIG. 4. As shown in FIG. 4, the engaging member 32 is moved to the engaging groove 33 at the bottom part of the main body 10 so that the engaging member 32 is engaged with the engaging groove 33 when the lower cover 30 is mounted to the main body 10. At this time, the front part of the main body 10 and the front part of the lower cover 30 together form the same plane, whereby the aesthetic appearance of the refrigerator is provided. Furthermore, the engaging member 32 and the engaging groove 33 are longitudinally formed so that the engaging member 32 is successively engaged with the engaging groove 33. Consequently, there is no gap between the main body 10 and the lower cover 30.

Preferably, the inner height t1 of the engaging groove 33 is larger than the vertical thickness t2 of the engaging member 32 so that the engaging member is easily engaged with the engaging groove 33. The engaging member 32 is provided with a bent portion 36 elastically deformed so that the engaging member 32 is forcibly engaged with the engaging groove 33. The bent portion 36 comprises: a first bent portion 36*a* bent from the position spaced a prescribed distance from the front part 31 of the lower cover 30 toward the rear of the bent portion 36 while being inclined downward; and a second bent portion 36*b* bent from the first bent portion 36*a* toward the rear of the main body 10. Consequently, the front upper part and the rear lower part of the engaging member 32 elastically contact the inner upper part and the inner lower part of the engaging groove 33 so that the engaging member 32 is engaged with the engaged groove 33 without shaking when the engaging member 32 is engaged with the engaging groove 33, and the gap between the upper part of the lower cover 30 and the bottom part of the main body 10 is minimized.

As shown in FIG. 2, the lower cover 30 is provided at both sides thereof with opened portions 37, through which the hinges 16, which support the doors 14 and 15, are extended forward, respectively. In this embodiment, the opened portions 37 are formed at both sides of the lower cover 30 since the hinges 16 are provided at both sides of the main body 10 for supporting the freezer compartment door 14 and the refrigerator compartment door 15. It is understood, therefore, that the opened portion 37 may be formed at only one side of the lower cover 30 since the hinge 16 is provided at one side of the main body 10 in the case of a refrigerator having one door.

The lower cover 30 is fixed to the main body 10 at both sides of the lower cover 30 by means of fixing screws 38 in addition to the engagement of the engaging member 32 and the engaging groove 33. To this end, the lower cover 30 is provided at both opened portions 37 thereof with first screw-engaging parts 39, which are extended rearward by a prescribed length. The main body 10 is provided at the bottom part thereof with second screw-engaging parts 40, which correspond to the first screw-engaging parts 39 and are engaged with the first screw-engaging parts 39 by means of the fixing screws 38, respectively, as shown in FIGS. 3 and 4. The second screw-engaging parts 40 are extended downward by a prescribed length from the bottom part of the main body 10 so that the second screw-engaging parts 40 are engaged with the first screw-engaging parts 39. The second screw-engaging parts 40 may be integrally formed with the supporting member 35, or fixed to the bottom part of the main body 10 by means of welding or screw fixing.

With the above-described construction, the first screw-engaging parts 39 are fixed to the second screw-engaging parts 40 by means of the fixing screws 38 while the lower cover 30 is fixed to the lower end of the main body 10 by means of the engagement of the engaging member 32 and the engaging groove 33, whereby the lower cover 30 is securely fixed to the main body 10. Also, the fixing screws 38 are fixed to the rear ends of the first screw-engaging parts 39, which are extended by a prescribed length from the opened portions 37 to the inside of the lower cover 30, whereby the screw-engaging parts fixed by means of the fixing screws 38 are not exposed to the outside. Consequently, the front part of the refrigerator has an aesthetic appearance. When it is necessary to separate the lower cover 30 from the main body 10, a disengaging tool, such as a screwdriver, is inserted through the opened portions 37 so that the fixing screws 38 are easily disengaged from the first and second screw-engaging parts 40. Consequently, the lower cover is easily separated from the main body 10.

As apparent from the above description, the present invention provides a refrigerator including a lower cover, which is not protruded from the front part of a main body of the refrigerator. Screw-engaging parts fixed by means of fixing screws are disposed inside of the lower cover, and thus not exposed to the outside. Consequently, the refrigerator has an aesthetic appearance.

Furthermore, the upper end of the lower cover is successively engaged with the lower end of the main body by means of the engagement of an engaging member with an engaging groove, which are longitudinally formed in the lateral direction of the lower cover. Consequently, formation of a gap between the lower cover and the lower end of main body is prevented.

Although the preferred embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a main body having a storage compartment defined therein and comprising a supporting member connected with a bottom part thereof of the main body and including an engaging groove; and a lower cover mounted to a lower end of a front part of the main body such that a front part of the lower cover and the front part of the main body together form a same plane, the lower cover comprising an engaging member bent from an upper end of the lower cover in a direction towards a rear of the main body to be inserted into the engaging groove.

2. The refrigerator according to claim 1, wherein the engaging groove has an inner height larger than a vertical thickness of the engaging member, and wherein the engaging member is provided with a bent portion elastically deformed so that the engaging member is forcibly engaged with the engaging groove.

3. The refrigerator according to claim 2, wherein the bent portion comprises:

a first bent portion bent from the position spaced a prescribed distance from the front part of the lower cover toward a rear of the bent portion while being inclined downward; and a second bent portion bent from the first bent portion toward the rear of the main body.

4. The refrigerator according to claim 1, wherein the engaging member and the engaging groove are successively formed in a lateral direction of the lower cover.

5. The refrigerator according to claim 1, further comprising:

at least one door attached to the front part of the main body; and at least one hinge provided at at least one of the lower sides of the front part of the main body for supporting the door, wherein the lower cover includes at least one opened portion allowing the hinge to be extended forward therethrough.

6. The refrigerator according to claim 5, further comprising:

first screw-engaging parts extended a prescribed length from the at least one opened portion toward the rear of the main body for fixing the lower cover;

second screw-engaging parts provided at the bottom part of the main body, the second screw-engaging parts corresponding to the first screw-engaging parts; and fixing screws fixing the first screw-engaging parts to the second screw-engaging parts.

7. The refrigerator according to claim 1, wherein the front part of the lower cover comprises a length corresponding to the width of the front part of the main body and a height corresponding to the height of the space between the lower end of the front part of the main body and the floor.

8. A refrigerator comprising:

a main body having a storage compartment defined therein; and a lower cover mounted to a lower end of a front part of the main body such that a front part of the lower cover and the front part of the main body together form a same plane, wherein the lower cover comprises an engaging member bent from an upper end of the lower cover in a direction towards a rear of the main body, while being extended a prescribed length, the engaging member being successively formed in a lateral direction thereof, and wherein the main body comprises an engaging groove at a bottom part thereof, the engaging groove corresponding to the engaging member of the lower cover, the engaging member of the lower cover being engaged with the engaging groove of the main body.

9. The refrigerator according to claim 8, further comprising:

at least one door attached to the front part of the main body; and at least one hinge provided at at least one of the lower sides of the front part of the main body for supporting the door, wherein the lower cover includes at least one opened portion allowing the hinge to be extended forward therethrough.

10. The refrigerator according to claim 9, further comprising:

first screw-engaging parts extended a prescribed length from the at least one opened portion toward the rear of the main body for fixing the lower cover;

second screw-engaging parts provided at the bottom part of the main body, the second screw-engaging parts correspond to the first screw-engaging parts; and fixing screws fixing the first screw-engaging parts to the second screw-engaging parts.

* * * * *